US010031541B1

(12) United States Patent
Bernardon

(10) Patent No.: US 10,031,541 B1
(45) Date of Patent: Jul. 24, 2018

(54) CURRENT SENSING FOR LINEAR VOLTAGE REGULATOR

(71) Applicant: Infineon Technologies AG, Neubiberg (DE)

(72) Inventor: Derek Bernardon, Villach (AT)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 15/641,697

(22) Filed: Jul. 5, 2017

(51) Int. Cl.
*G05F 1/46* (2006.01)
*G05F 1/565* (2006.01)
*G05F 1/575* (2006.01)
*G05F 1/625* (2006.01)

(52) U.S. Cl.
CPC ..... *G05F 1/625* (2013.01)

(58) Field of Classification Search
CPC ..... G05F 1/461; G05F 1/462; G05F 1/565; G05F 1/575
See application file for complete search history.

(56) References Cited

U.S. PATENT DOCUMENTS 9,874,888 B2 * 1/2018 Bernardon ..... G05F 1/575
9,886,045 B2 * 2/2018 Endo ..... G05F 1/575
2013/0119954 A1 * 5/2013 Lo ..... G05F 1/10 323/280
2016/0179115 A1 * 6/2016 Kronmueller ..... G05F 1/575 323/280
2016/0282890 A1 * 9/2016 Malinowski ..... G05F 1/575
2017/0047836 A1 * 2/2017 Endo ..... G05F 1/575

* cited by examiner

*Primary Examiner* — Timothy J Dole
*Assistant Examiner* — Sisay G Tiku
(74) *Attorney, Agent, or Firm* — Shumaker & Sieffert, P.A.

(57) ABSTRACT

In one example, a circuit includes a pass module, a first sensing module, a second sensing module, a decision module, and a control module. The pass module is configured to modify, based on a control signal, a resistance of a channel that electrically connects an input voltage and a load. The first sensing module is configured to generate a first sensed current. The second sensing module is configured to generate a second sensed current. The decision module is configured to generate a first decision current, generate a second decision current, and generate a composite sensed current based on a summation of the first decision current, the second decision current, the first sensed current, and the second sensed current. The control module is configured to generate the control signal based on the composite sensed current.

20 Claims, 11 Drawing Sheets

CURRENT SENSING FOR LINEAR VOLTAGE REGULATOR

TECHNICAL FIELD

This disclosure relates to a linear voltage regulator, such as a low-dropout (LDO) regulator, that is configured to regulate an output voltage.

BACKGROUND

Linear voltage regulators may regulate an output voltage. For example, a linear voltage regulator may output a voltage of 5 volts using a supplied voltage of 10 volts. A low-dropout (LDO) regulator may regulate an output voltage that is close to a supplied voltage. For instance, an LDO regulator may output a voltage of 5 volts using a supplied voltage of 5.5 volts. In any case, it may be desirable for linear voltage regulators, such as LDO regulators, to quickly achieve a regulated voltage, be stable across a full range of output voltages, and have a low power consumption.

SUMMARY

In general, this disclosure is directed to techniques for current sensing. To maintain stability and provide protection from overcurrent, systems may sense current at the linear voltage regulator. Systems may use different sensing schemes that, for example, may each include different combinations of transistors to "mirror" or generate a current that corresponds to a sensed current at the linear voltage regulator. A decision module may generate a composite sensed current using multiple sensing schemes.

In an example, a circuit for voltage regulation includes a pass module, a first sensing module, a second sensing module, a decision module, and a control module. The pass module is configured to modify, based on a control signal, a resistance of a channel that electrically connects an input voltage and a load. The first sensing module is configured to generate a first sensed current based on a current at a series path comprising at least the pass module and the load. The second sensing module is configured to generate a second sensed current based on the current at the series path comprising at least the pass module and the load. The decision module is configured to generate a first decision current that corresponds to a subtraction of the first sensed current from the second sensed current when the second sensed current is greater than the first sensed current and corresponds to zero current when the second sensed current is not greater than the first sensed current and to generate a second decision current that corresponds to a subtraction of the second sensed current from the first sensed current when the first sensed current is greater than the second sensed current and corresponds to zero current when the first sensed current is not greater than the second sensed current. The decision module is further configured to generate a composite sensed current based on a summation of the first decision current, the second decision current, the first sensed current, and the second sensed current. The control module is configured to generate the control signal based on the composite sensed current.

In another example, a method for voltage regulation includes modifying, by a pass module of a circuit, based on a control signal, a resistance of a channel that electrically connects an input voltage and a load. The method further includes generating, by a first sensing module of the circuit, a first sensed current based on a current at a series path comprising at least the pass module and the load. The method further includes generating, by a second sensing module of the circuit, a second sensed current based on the current at the series path comprising at least the pass module and the load. The method further includes generating, by a decision module of the circuit, a first decision current that corresponds to a subtraction of the first sensed current from the second sensed current when the second sensed current is greater than the first sensed current and corresponds to zero current when the second sensed current is not greater than the first sensed current. The method further includes generating, by a decision module of the circuit, a second decision current that corresponds to a subtraction of the second sensed current from the first sensed current when the first sensed current is greater than the second sensed current and corresponds to zero current when the first sensed current is not greater than the second sensed current. The method further includes generating, by a decision module of the circuit, a composite sensed current based on a summation of the first decision current, the second decision current, the first sensed current, and the second sensed current. The method further includes generating, by a control module of the circuit, the control signal based on the composite sensed current.

In another example, a circuit includes a voltage source, a load, a pass module, a first sensing module, a second sensing module, a decision module, and a control module. The voltage source is configured to supply an input voltage. The pass module is configured to modify, based on a control signal, a resistance of a channel that electrically connects an input voltage and a load. The first sensing module is configured to generate a first sensed current to be proportional to a current at a series path comprising at least the pass module and the load when a voltage output at the pass module is less than a first threshold. The second sensing module is configured to generate a second sensed current to be proportional to the current at the series path comprising at least the pass module and the load when the voltage output at the pass module is greater than a second threshold, the second threshold being less than the first threshold. The decision module is configured to generate a first decision current that corresponds to a subtraction of the first sensed current from the second sensed current when the second sensed current is greater than the first sensed current and corresponds to zero current when the second sensed current is not greater than the first sensed current, to generate a second decision current that corresponds to a subtraction of the second sensed current from the first sensed current when the first sensed current is greater than the second sensed current and corresponds to zero current when the first sensed current is not greater than the second sensed current, and to generate a composite sensed current based on a summation of the first decision current, the second decision current, the first sensed current, and the second sensed current. The control module is configured to generate the control signal based on the composite sensed current.

Details of these and other examples are set forth in the accompanying drawings and the description below. Other features, objects, and advantages will be apparent from the description and drawings, and from the claims.

DETAILED DESCRIPTION

In general, this disclosure is directed to techniques for sensing current in a linear voltage regulator, for instance, but not limited to, a low-dropout (LDO) regulator, across a full range of output voltages using multiple sensing schemes. Such sensing schemes may use combinations of transistors to "mirror" or generate a current that corresponds to a sensed current at the linear voltage regulator.

In some systems, a single sensing scheme is selected to control the output voltage of a linear voltage regulator, such as, but not limited to, an LDO regulator. For instance, a designer may select between a sensing scheme that operates for output voltages that are greater than a particular voltage or another sensing scheme that operates for output voltages that are less than another particular voltage. In some applications, however, it is desirable for a sensing scheme that operates for output voltages that extend beyond a single sensing scheme.

Some systems may select a sensing scheme from a set of sensing schemes using a switch. For example, such systems may use digital components, such as a comparator, to select a sensing scheme. In this example, such systems may cause a switch to receive an output from a high voltage sensing scheme instead of a low voltage sensing scheme when the digital components detect that an output voltage exceeds a voltage threshold for the low voltage sensing scheme. However, such switching between different sensing scheme may cause a linear voltage regulator to have a discontinuous transfer function, thereby resulting in unstable operating points of the linear voltage regulator.

In accordance with embodiments described herein, rather than limiting a linear voltage regulator to applications that operate within a specific operating voltage range of a selected sensing scheme or necessarily operating the linear voltage regulator with a discontinuous transfer function, a system may generate a composite sensed current using multiple sensing schemes.

Figure 1:
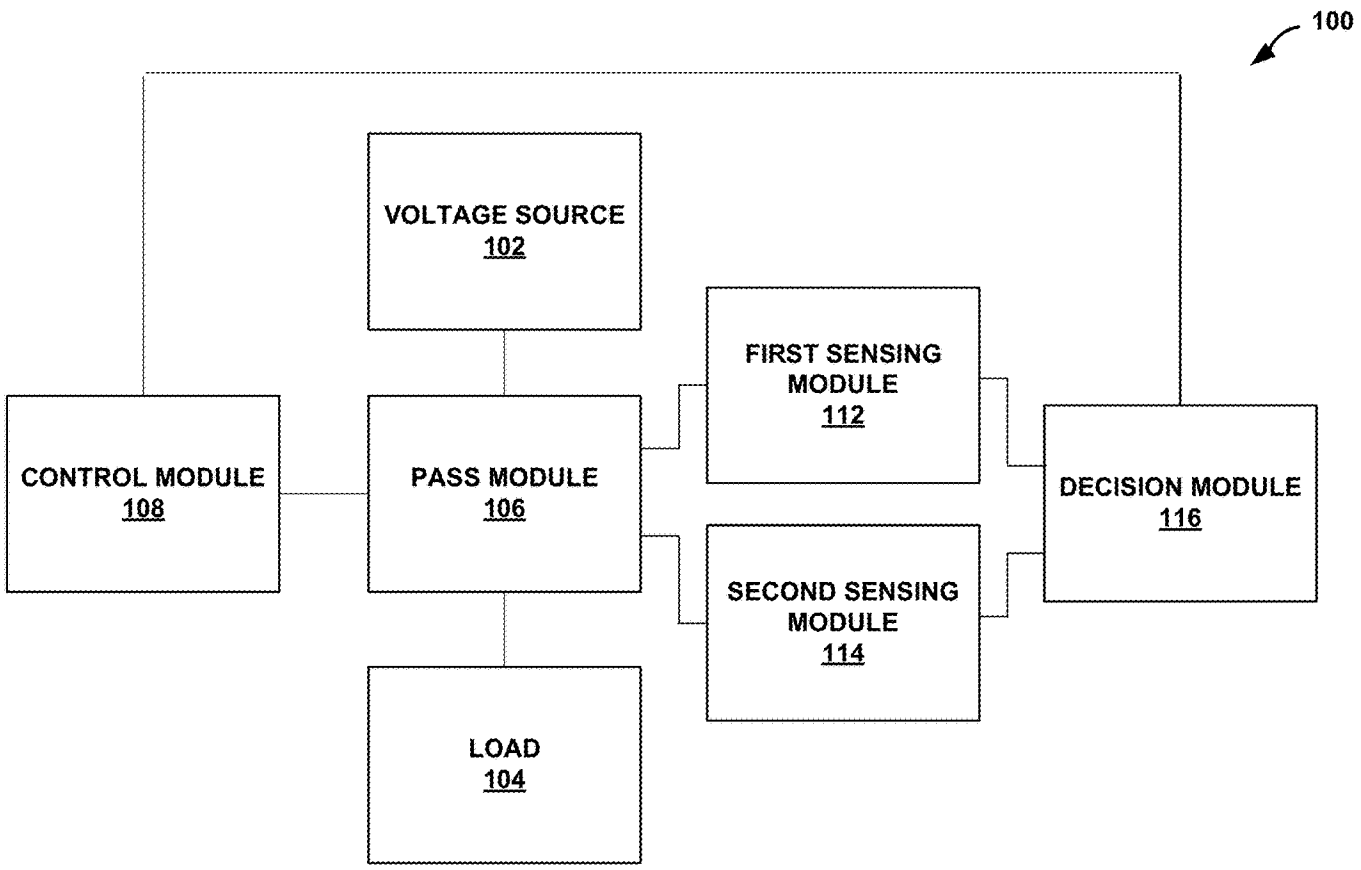
FIG. 1 is a block diagram illustrating an example system configured to sense current for a full range of output voltages, in accordance with one or more techniques of this disclosure.

FIG. 1 is a block diagram illustrating an example system 100 configured to sense current for a full range of output voltages, in accordance with one or more techniques of this disclosure. As illustrated in the example of FIG. 1, system 100 may include voltage source 102, load 104, pass module 106, control module 108, first sensing module 112, second sensing module 114, and decision module 116.

Voltage source 102 may be configured to provide electrical power to one or more other components of system 100. For instance, voltage source 102 may be configured to supply an input power to load 104. In some examples, voltage source 102 includes a battery which may be configured to store electrical energy. Examples of batteries may include, but are not limited to, nickel-cadmium, lead-acid, nickel-metal hydride, nickel-zinc, silver-oxide, lithium-ion, lithium polymer, any other type of rechargeable battery, or any combination of the same. In some examples, voltage source 102 may include an output of a power converter or power inverter. For instance, voltage source 102 may include an output of a direct current (DC) to DC power converter, an alternating current (AC) to DC power converter, and the like. In some examples, voltage source 102 may represent a connection to an electrical supply grid. In some examples, the input power signal provided by voltage source 102 may be a DC input power signal. For instance, in some examples, voltage source 102 may be configured to provide a DC input power signal in the range of ~5 $V_{DC}$ to ~40 $V_{DC}$.

Load 104 may include devices configured to accept, via pass module 106, current from voltage source 102. In some examples, load 104 may be a resistive load. Examples of resistive loads may include seat adjustment, auxiliary heating, window heating, light emitting diodes (LEDs), rear lighting, or other resistive loads. In other examples, load 104 may be an inductive load. Examples of inductive loads may include actuators, motors, and pumps used in one or more of a wiper system, anti-lock brake system (ABS), electronic braking system (EBS), relay, battery disconnect, fan, or other systems that include inductive loads. In still other examples, load 104 may be a capacitive load. Examples of capacitive loads may include lighting elements, such as a Xenon arc lamp. In yet other examples, loads may be combinations of resistive, inductive, and capacitive loads.

Pass module 106 may include any device suitable to control an amount of current flowing through pass module 106. More specifically, in some examples, pass module 106 may be configured to electrically couple, using a channel having a resistance, voltage source 102 and load 104 and to modify the resistance of the channel based on a control signal. For example, pass module 106 may include one or more pass elements that may each be switched to control a current flow through a respective pass element. Examples of pass elements may include, but are not limited to, silicon controlled rectifier (SCR), a Field Effect Transistor (FET), and bipolar junction transistor (BJT). Examples of FETs may include, but are not limited to, junction field-effect transistor (JFET), metal-oxide-semiconductor FET (MOSFET), dual-gate MOSFET, insulated-gate bipolar transistor (IGBT), any other type of FET, or any combination of the same. Examples of MOSFETS may include, but are not limited to, depletion mode p-channel MOSFET (PMOS), enhancement mode PMOS, depletion mode n-channel MOSFET (NMOS), enhancement mode NMOS, double-diffused MOSFET (DMOS), or any other type of MOSFET, or any combination of the same. Examples of BJTs may include, but are not limited to, PNP, NPN, heterojunction, or any other type of BJT, or any combination of the same. It should be understood that pass elements may be high-side or low-side pass elements. Additionally, pass elements may be voltage-controlled and/or current-controlled. Examples of current-controlled switching elements may include, but are not limited to, gallium nitride (GaN) MOSFETs, BJTs, or other current-controlled elements.

Control module 108 may be configured to control pass module 106. For example, control module 108 may generate a control signal based on a composite sensed current output by decision module 116. In some examples, control module 108 may be a microcontroller on a single integrated circuit containing a processor core, memory, inputs, and outputs. For example, control module 108 may include one or more processors, including one or more microprocessors, digital signal processors (DSPs), application specific integrated circuits (ASICs), field programmable gate arrays (FPGAs), or any other equivalent integrated or discrete logic circuitry, as well as any combinations of such components. The term "processor" or "processing circuitry" may generally refer to any of the foregoing logic circuitry, alone or in combination with other logic circuitry, or any other equivalent circuitry. In some examples, control module 108 may be a combination of one or more analog components and one or more digital components. In some examples, control module 108 may be an analog operational amplifier (op amp) with the function of a proportional-integral (PI) regulator or a proportional-integral-derivative PID regulator.

First sensing module 112 may be configured to estimate a current flowing from voltage source 102, via pass module 106, to load 104. For example, first sensing module 112 may include one or more transistors configured to mirror the current flowing from voltage source 102, via pass module 106, to load 104. Examples of such transistors may include, but are not limited to, depletion mode PMOS, enhancement mode PMOS, depletion mode NMOS, enhancement mode NMOS, DMOS, or any other type of MOSFET, or any combination of the same. In some examples, first sensing module 112 may include analog components. Examples of analog components may include, but are not limited to, transistors, operational amplifiers, and other analog components. In some examples, first sensing module 112 may omit digital components.

Second sensing module 114 may be configured to estimate a current flowing from voltage source 102, via pass module 106, to load 104. For example, second sensing module 114 may include one or more transistors configured to mirror the current flowing from voltage source 102, via pass module 106, to load 104. In some examples, second sensing module 114 may include analog components. In some examples, second sensing module 114 may omit digital components.

Decision module 116 may be configured to generate a voltage indicating a current at pass module 106. For example, decision module 116 may determine which one of a first sensed current and a second sensed current is greater and output the greater sensed current. Decision module 116 may include one or more transistors configured to generate a composite sensed current based on an output from first sensing module 112 and an output from second sensing module 114 for output to control module 108. In some examples, decision module 116 may include analog components. In some examples, decision module 116 may omit digital components.

In accordance with one or more techniques described, pass module 106 modifies a resistance of a channel that electrically connects voltage source 102 and load 104 based on a control signal. First sensing module 112 generates a first sensed current based on current at a series path formed by pass module 106 and load 104. Second sensing module 114 generates a second sensed current based on current at the series path formed by pass module 106 and load 104. Decision module 116 generates a first decision current that corresponds to a subtraction of the first sensed current from the second sensed current when the second sensed current is greater than the first sensed current and corresponds to zero current when the second sensed current is not greater than the first sensed current. Decision module 116 generates a second decision current that corresponds to a subtraction of the second sensed current from the first sensed current when the first sensed current is greater than the second sensed current and corresponds to zero current when the first sensed current is not greater than the second sensed current. Decision module 116 generates a composite sensed current based on a summation of the first decision current, the second decision current, the first sensed current, and the second sensed current. Control module 108 generates the control signal that controls pass module 106 based on the composite sensed current output by decision module 116. In this manner, one or more techniques described permit system 100 to control pass module 106 using a continuous transfer function for a full range of output voltages, thereby resulting in stable operation of system 100. Although system 100 of FIG. 1 illustrates only two sensing modules (e.g., first sensing module 112, and second sensing module 114) some embodiments may include more than two sensing modules.

Figure 2:
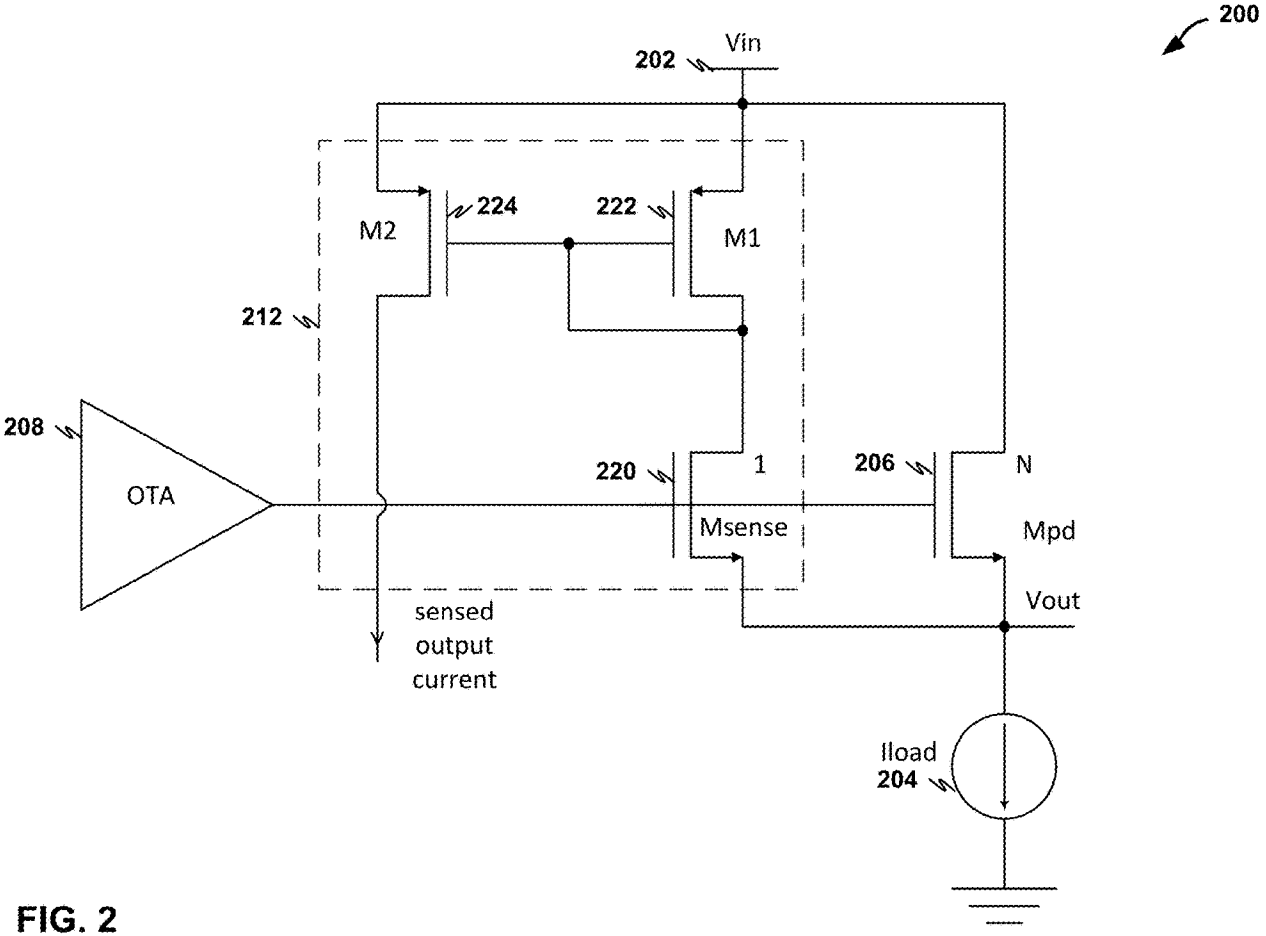
FIG. 2 is a system diagram illustrating an example first sensing module of the system of FIG. 1, in accordance with one or more techniques of this disclosure.

FIG. 2 is a system diagram illustrating an example first sensing module 212 of system 100 of FIG. 1, in accordance with one or more techniques of this disclosure. As illustrated, circuit 200 includes voltage source 202, load 204, pass module 206, operational transconductance amplifier ("OTA") 208, and first sensing module 212. Although FIG. 2 illustrates OTA 208 as an operational transconductance amplifier, in some examples, OTA 208 may be an operational amplifier. Voltage source 202 may be an example of voltage source 102 of FIG. 1. Load 204 may be an example of load 104 of FIG. 1. Pass module 206 may be an example of pass module 106 of FIG. 1. OTA 208 may be an example of a component of control module 108 of FIG. 1. First sensing module 212 may be an example of first sensing module 112 of FIG. 1.

First sensing module 212 may include transistors 220, 222, and 224. As shown, transistor 220 may form a '1' to 'N' current mirror with pass module 206. Further, transistor 224 may form current mirror with transistor 222. First sensing module 212 may generate a sensed current to be proportional (e.g., equal) to the current at pass module 206 when the input voltage ('$V_{in}$') generated by voltage source 202 is higher than the output voltage ('$V_{out}$') output at load 204 by a margin of at least a saturation drain to source voltage of transistor 220 ('$V_{ds_sense,sat}$') plus a gate to source voltage of transistor 222 ('$V_{gs1}$') (e.g., $V_{in}>V_{out}+V_{ds_sense,sat}+V_{gs1}$). Said differently, first sensing module 212 may generate a sensed current to be proportional to the current at pass module 206 when a voltage output at pass module 206 is less than a threshold. In some examples, the threshold may correspond to an output voltage that is the input voltage ('$V_{in}$') reduced by a saturation drain to source voltage of transistor 220 ('$V_{ds_sense,sat}$') and reduced by a gate to source voltage of transistor 222 ('$V_{gs1}$'). However, the first sensing module 212 may generate a sensed current that is not proportional to the current at pass module 206 when a voltage output at pass module 206 is greater than the threshold. That is, first sensing module 212 may generate a sensed current that is proportional to the current at pass module 206 only when a voltage output at pass module 206 is less than the threshold.

Figure 3:
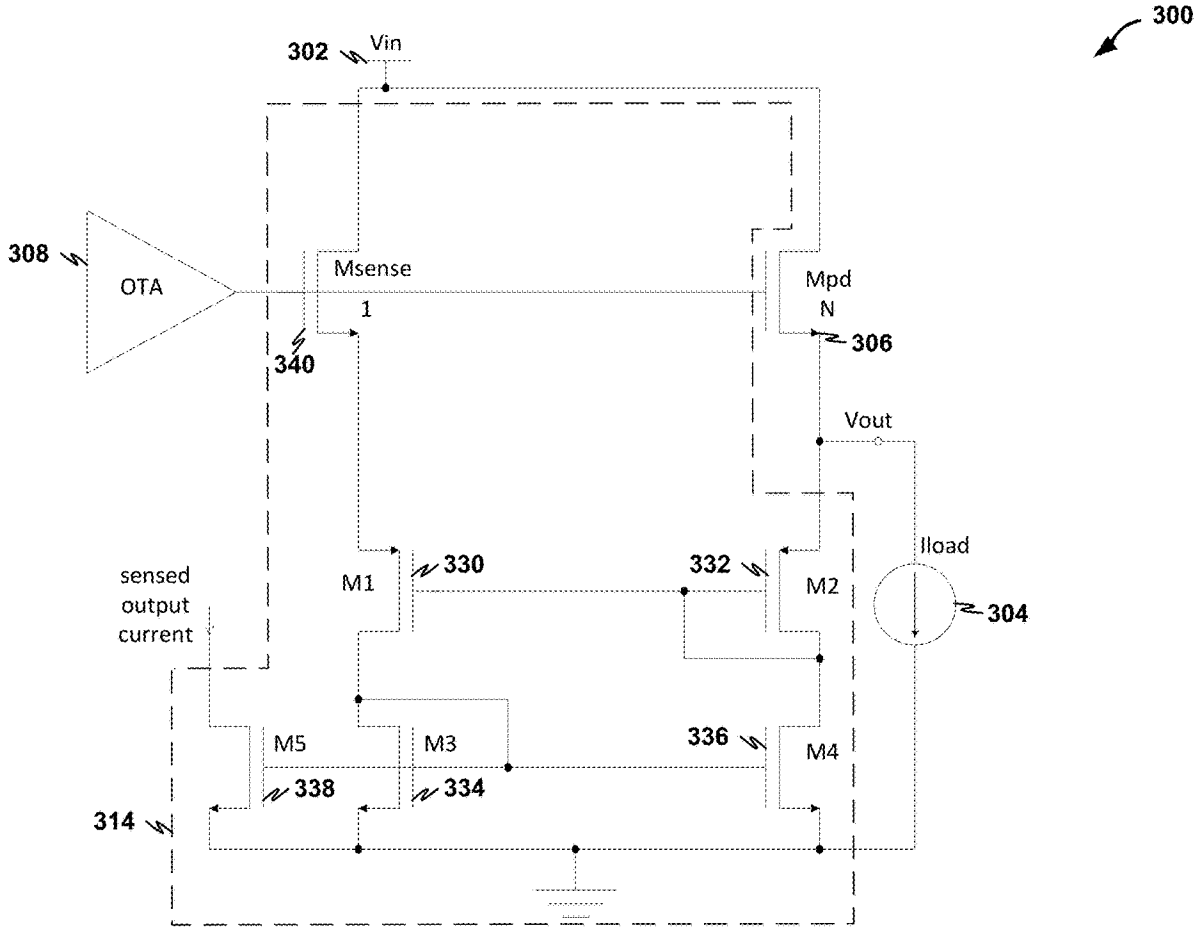
FIG. 3 is a system diagram illustrating an example second sensing module of the system of FIG. 1, in accordance with one or more techniques of this disclosure.

FIG. 3 is a system diagram illustrating an example second sensing module 314 of system 100 of FIG. 1, in accordance with one or more techniques of this disclosure. As illustrated, circuit 300 includes voltage source 302, load 304, pass module 306, OTA 308, and second sensing module 314. Voltage source 302 may be an example of voltage source 102 of FIG. 1. Load 304 may be an example of load 104 of FIG. 1. Pass module 306 may be an example of pass module 106 of FIG. 1. OTA 308 may be an example of a component of control module 108 of FIG. 1. Although FIG. 3 illustrates OTA 308 as an operational transconductance amplifier, in some examples, OTA 308 may be an operational amplifier. Second sensing module 314 may be an example of second sensing module 114 of FIG. 1.

Second sensing module 314 may include transistors 330, 332, 334, 336, 338, and 340. As shown, transistors 334 and 336 form a current mirror that forces transistors 330 and 332 to have the same current. Because transistors 330 and 332 have a common gate voltage and a common current, a gate to source voltage at transistor 330 ('$V_{gs1}$') is equal to a gate to source voltage at transistor 332 ('$V_{gs2}$'). Therefore, a source voltage at transistor 340 ('$V_{s,Msense}$') may equal the output voltage ('$V_{out}$') at pass module 306 ('$V_{s,Mpd}$'). Moreover, transistor 340 ('$M_{sense}$') has the same gate voltage of pass module 306 ('$M_{pd}$') which, together with the fact that the source voltage of transistor 340 ('$V_{gs,Msense}$') equals the source voltage of pass module 306 ('$V_{s,Mpd}$') results in the gate to source voltage of transistor 340 ('$V_{gs,Msense}$') equaling the gate to source voltage of pass module 306 ('$V_{gs,Mpd}$'). Therefore, a drain to source current at transistor 340 ('$I_{ds,Msense}$') is equal to a drain to source current at pass module 306 divided by 'N' (e.g., '$I_{ds,Mpd}$/N'), where N is a design variable of pass module 306 (e.g., N=((W/L)$_{,Mpd}$/(W/L)$_{,Msense}$). As such, current flowing through a path formed by transistor 340 ('$M_{sense}$'), transistor 330 ('M1'), and transistor 334 ('M3') may be proportional to current flowing through pass module 306 ('$M_{pd}$'). Further, transistor 338 ('M5') may form a current mirror that generates a sensed current that is proportional to the current flowing through a path formed by transistor 340 ('$M_{sense}$'), transistor 330 ('M1'), and transistor 334 ('M3') (e.g., proportional to current flowing through pass module 306 ('$M_{pd}$')).

The current sensing structure formed by transistors 330-338 may operate for output voltages that are higher than the greater of $V_{gs2}+V_{ds4,sat}$ and $V_{gs1}+V_{gs3}$. However, when the output voltage ('$V_{out}$') goes below this limit, the output current generated by transistor 338 may not correspond to the current at pass module 306. Said differently, second sensing module 314 may generate a sensed current that is proportional to the current at pass module 206 only when a voltage output at pass module 206 is greater than a threshold (e.g., $V_{gs2}+V_{ds4,sat}$).

Figure 4:
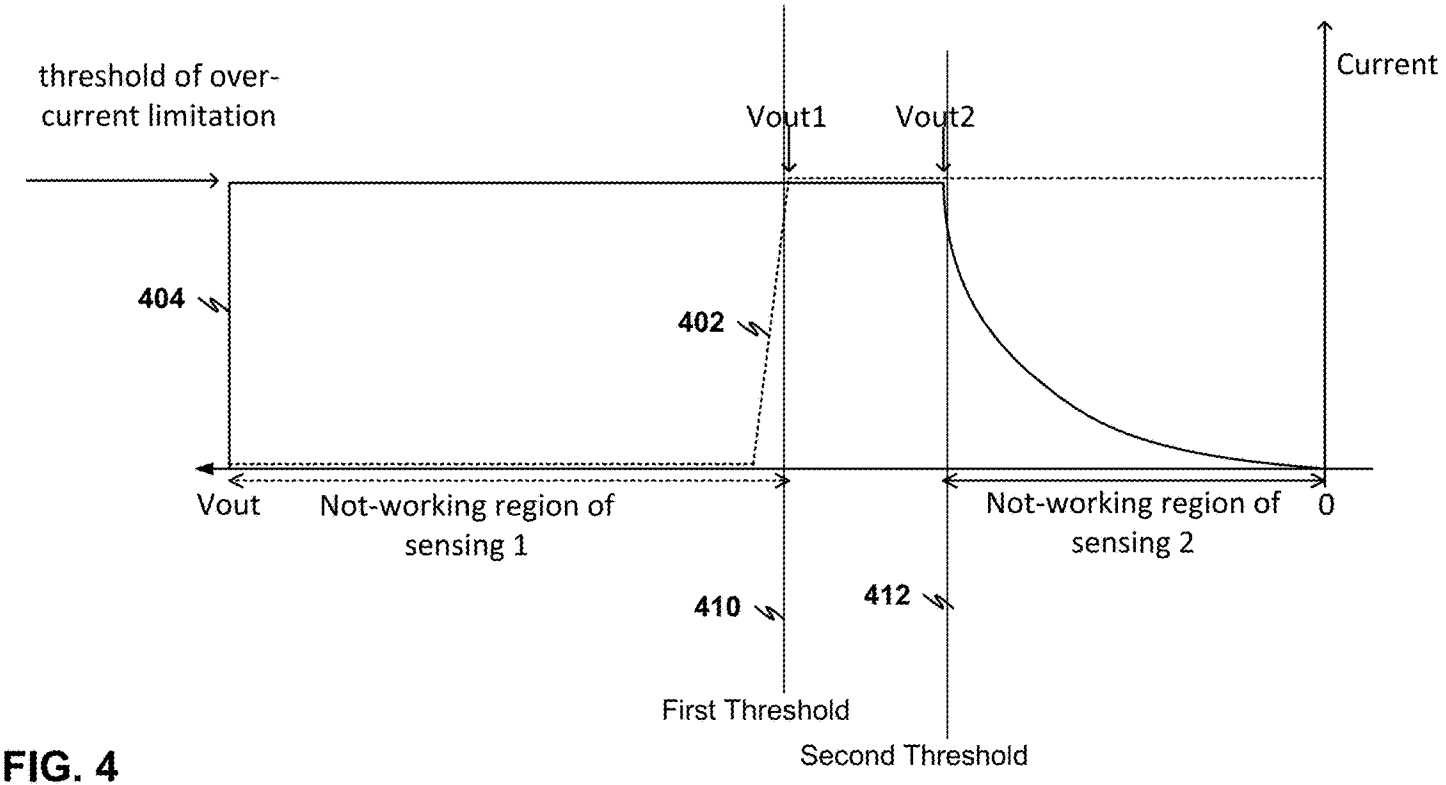
FIG. 4 is a graphical illustration of a performance of the first sensing module of FIG. 2 and the second sensing module of FIG. 3, in accordance with one or more techniques of this disclosure.

FIG. 4 is a graphical illustration of a performance of first sensing module 212 of FIG. 2 and second sensing module 314 of FIG. 3, in accordance with one or more techniques of this disclosure. The abscissa axis (e.g., horizontal) of FIG. 4 represents a voltage output at pass module 106 and the ordinate axis (e.g., vertical) of FIG. 4 represents a first sensed current 402 output by first sensing module 212 of FIG. 2 and a second sensed current 404 output by second sensing module 314 of FIG. 3. In this example, first sensing module 212 generates first sensed current 402 to be proportional to the current at pass module 106 when a voltage output at pass module 106 is less than first threshold 410. Additionally, in this example, second sensing module 314 generates second sensed current 404 to be proportional to the current at pass module 106 when a voltage output at pass module 106 is greater than second threshold 412. In this example, second threshold 412 is less than first threshold 410.

In the example of FIG. 4, first sensed current 402 is not proportional to a current at pass module 106 when the output voltage is greater than first threshold 410. However, in the example of FIG. 4, second sensed current 404 is proportional to a current at pass module 106 when the output voltage is greater than second threshold 412. Similarly, in the example of FIG. 4, second sensed current 404 is not proportional to a current at pass module 106 when the output voltage ('$V_{out}$') is less than second threshold 412. However, first sensed current 402 is proportional to a current at pass module 106 when the output voltage ('$V_{out}$') is less than first threshold 410.

Figure 5:
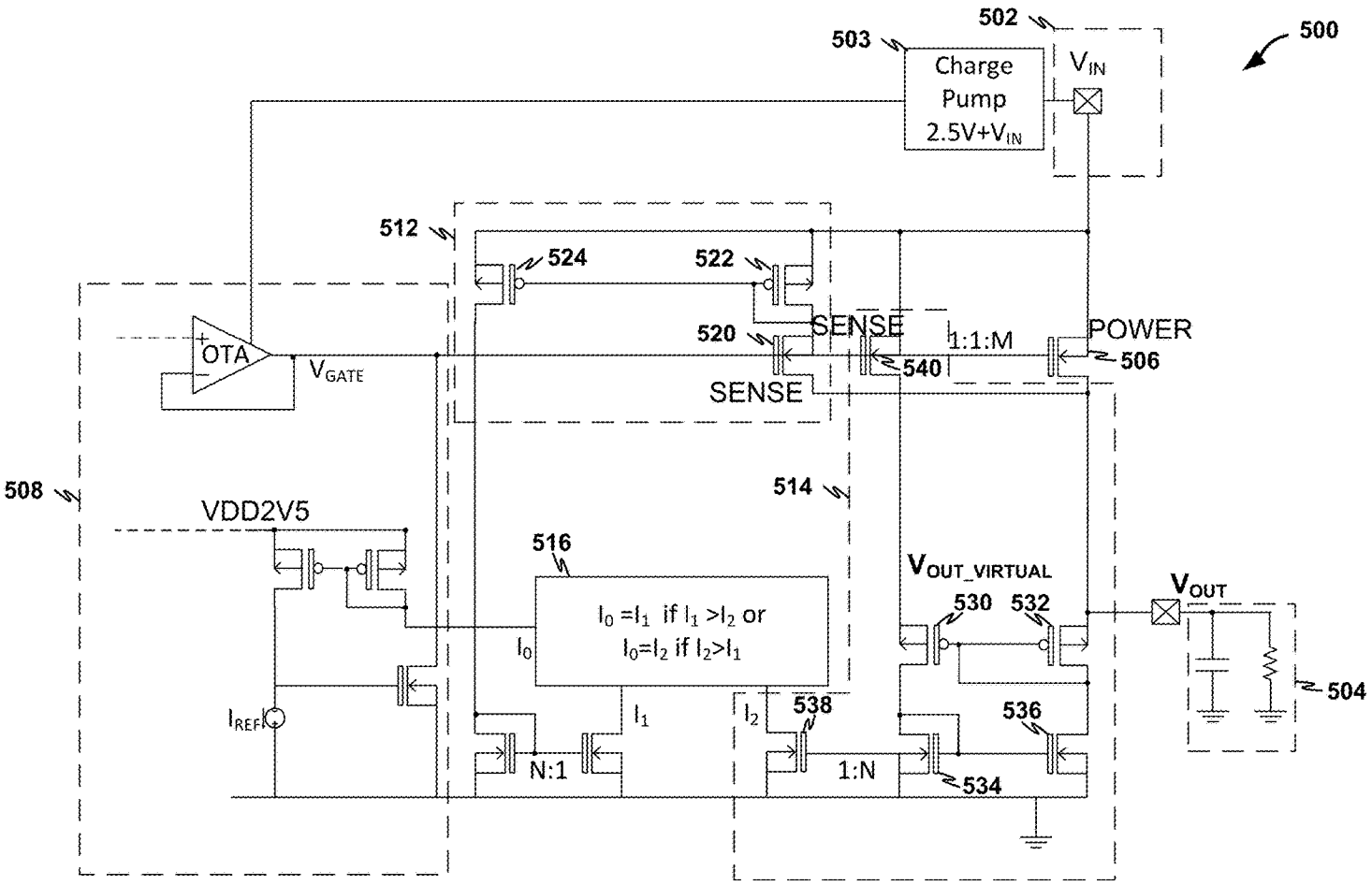
FIG. 5 is a circuit diagram illustrating an example first circuit of the system of FIG. 1, in accordance with one or more techniques of this disclosure.

FIG. 5 is a circuit diagram illustrating an example first circuit 500 of the system of FIG. 1, in accordance with one or more techniques of this disclosure. As illustrated, circuit 500 includes voltage source 502, charge pump 503, load 504, pass module 506, control module 508, first sensing module 512, second sensing module 514, and decision module 516. Voltage source 502 may be an example of voltage source 102 of FIG. 1. Charge pump 503 may be a charge pump configured to increase a voltage generated by voltage source 502 by 2.5 volts (V). Load 504 may be an example of load 104 of FIG. 1. Pass module 506 may be an example of pass module 106 of FIG. 1. Control module 508 may be an example of a component of control module 108 of FIG. 1. First sensing module 512 may be an example of first sensing module 112 of FIG. 1. Second sensing module 514 may be an example of second sensing module 114 of FIG. 1. Decision module 516 may be an example of decision module 116 of FIG. 1.

First sensing module 512 may include transistors 520, 522, and 524, which may be substantially similar to transistors 220, 222, and 224 of FIG. 2. For example, first sensing module 512 may generate a first sensed current that is proportional to the current at pass module 506 only when a voltage output at pass module 506 is less than a first threshold. The first threshold may correspond to an output voltage that is the input voltage ('$V_{in}$') generated by voltage source 502 reduced by a saturation drain to source voltage of transistor 520 ('$V_{ds_sense,sat}$') and reduced by a gate to source voltage of transistor 522 ('$V_{gs1}$'). Additionally, or alternatively, the threshold may correspond to an output voltage that is the input voltage ('$V_{in}$') generated by voltage source 502 reduced by a saturation drain to source voltage of pass module 506 ('$V_{ds_mpd,sat}$').

Second sensing module 514 may include transistors 530, 532, 534, 536, 538, and 540, which may be substantially similar to transistors 320-340 of FIG. 3. For example, second sensing module 514 may generate a second sensed current that is proportional to the current at pass module 506 only when a voltage output at pass module 506 is greater than a second threshold (e.g., $V_{gs2}+V_{ds4,sat}$).

In accordance with one or more techniques described, pass module 506 modifies a resistance of a channel that electrically connects voltage source 502 and load 504 based on a control signal. First sensing module 512 generates a first sensed current ('$I_1$') based on current at a series path formed by pass module 506 and load 504. Second sensing module 514 generates a second sensed current ('$I_2$') based on current at the series path formed by pass module 506 and load 504. Decision module 516 may determine which one of the first and second sensed currents is greater and outputs the greater sensed current. For example, decision module 516 generates a first decision current that corresponds to a subtraction of the first sensed current from the second sensed current when the second sensed current ('$I_2$') is greater than the first sensed current ('$I_1$') and corresponds to zero current when the second sensed current ('$I_2$') is not greater than the first sensed current ('$I_1$'). Decision module 116 generates a second decision current ('$I_2$') that corresponds to a subtraction of the second sensed current ('$I_2$') from the first sensed current ('$I_1$') when the first sensed current ('$I_1$') is greater than the second sensed current ('$I_2$') and corresponds to zero current when the first sensed current ('$I_1$') is not greater than the second sensed current ('$I_2$'). Decision module 116 generates a composite sensed current ('$I_0$') based on a summation of the first decision current, the second decision current, the first sensed current, and the second sensed current. Control module 108 generates the control signal that controls pass module 106 based on the composite sensed current output by decision module 116.

Figure 6:
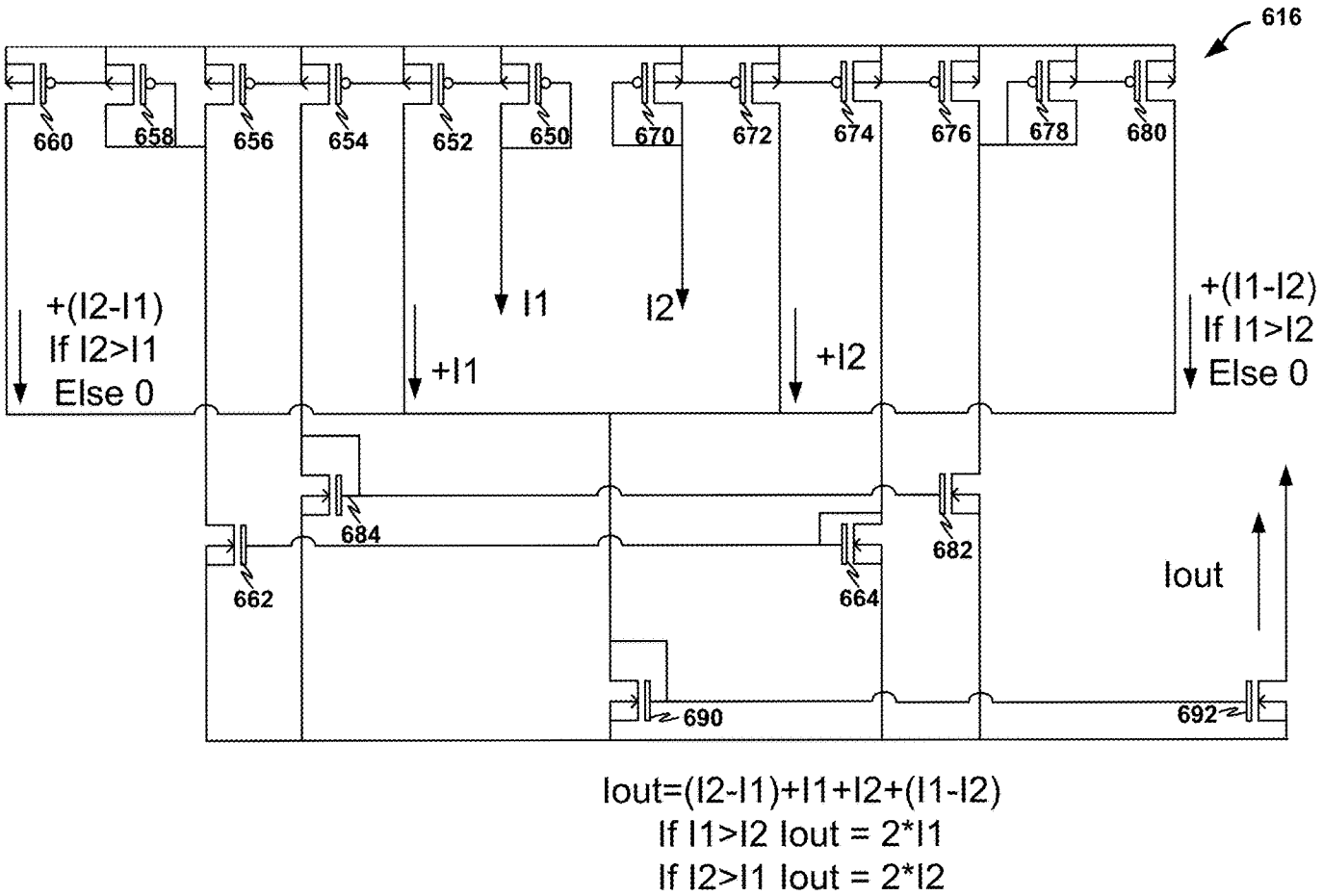
FIG. 6 is a circuit diagram illustrating an example decision module of the system of FIG. 1, in accordance with one or more techniques of this disclosure.

FIG. 6 is a circuit diagram illustrating an example decision module 616 of system 100 of FIG. 1, in accordance with one or more techniques of this disclosure. As shown, decision module 616 may include transistors 650-664, 670-684, 690, and 692.

Transistors 650 and 656 form a first sensed current mirror configured to generate a first source current that corresponds to the first sensed current. Transistors 662 and 664 form a second sensed current mirror configured to generate a first sink current that corresponds to the second sensed current. Transistor 658 forms a first diode configured to supply a first diode current corresponding to a subtraction of the first source current from the first sink current when the first sink current is greater than the first source current and to correspond to zero current when the first sink current is not greater than the first source current. Transistors 658 and 660 form a first decision current mirror configured to generate the first decision current ('+(I2−I1) If I2>I1 Else 0') to correspond to the first diode current.

Similarly, transistors 670 and 676 form a third sensed current mirror configured to generate a second source current that corresponds to the second sensed current. Transistors 682 and 684 form a fourth sensed current mirror configured to generate a second sink current that corresponds to the first sensed current. Transistor 678 forms a second diode configured to supply a second diode current corresponding to a subtraction of the second source current from the second sink current when the second sink current is greater than the second source current and to correspond to zero current when the second sink current is not greater than the second source current. Transistors 678 and 680 form a second decision current mirror configured to generate the second decision current ('+(I1−12) If I1>I2 Else 0') to correspond to the second diode current.

Additionally, as shown, transistors 650 and 652 form a fifth sensed current mirror configured to generate a current ('+I1') corresponding to the first sensed current. Similarly, transistors 670 and 672 form a sixth sensed current mirror configured to generate a current ('+I2') corresponding to the second sensed current. Transistors 690 and 692 form a composite sensed current mirror configured to generate the composite sensed current to correspond to a summation of the first decision current from the first decision current mirror, the second decision current from the second decision current mirror, the current corresponding to the first sensed current from the fifth sensed current mirror, and the current corresponding to the second sensed current from the sixth sensed current mirror.

Figure 7:
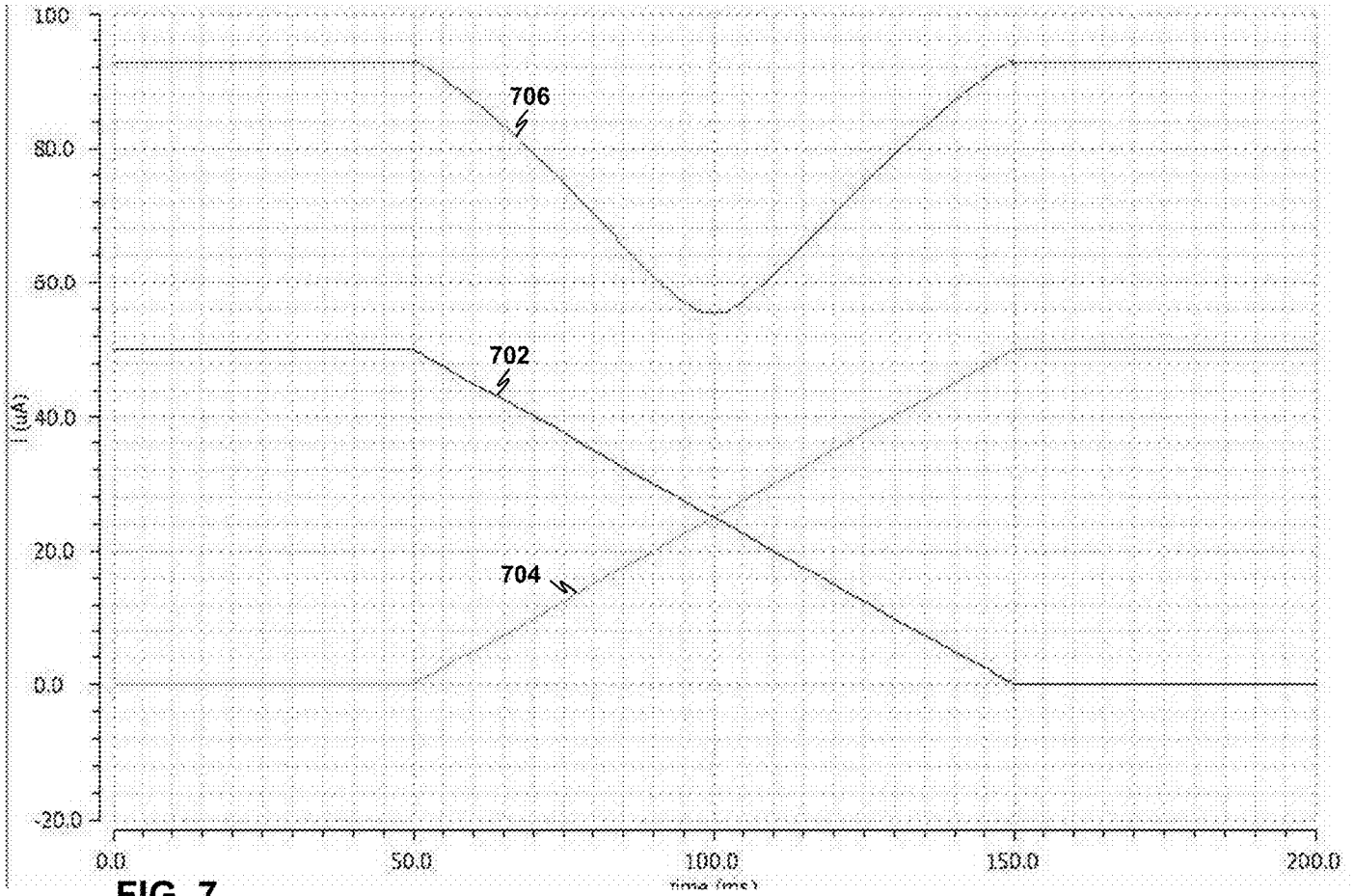
FIG. 7 is a first graphical illustration of a performance of the decision module of FIG. 6, in accordance with one or more techniques of this disclosure.

FIG. 7 is a first graphical illustration of a performance of the decision module of FIG. 6, in accordance with one or more techniques of this disclosure. The abscissa axis (e.g., horizontal) of FIG. 7 represents a time in milliseconds (ms) and the ordinate axis (e.g., vertical) of FIG. 7 represents a current in microamperes (μA). In the example of FIG. 7, decision module 616 of FIG. 6 receives first sensed current 702 and second sensed current 704. In this example, decision module 616 generates composite sensed current 706 to be proportional to first sensed current 702 when first sensed current 702 is greater than second sensed current 704. In this example, decision module 716 generates composite sensed current 706 to be proportional to second sensed current 704 when second sensed current 704 is greater than first sensed current 702.

Figure 8:
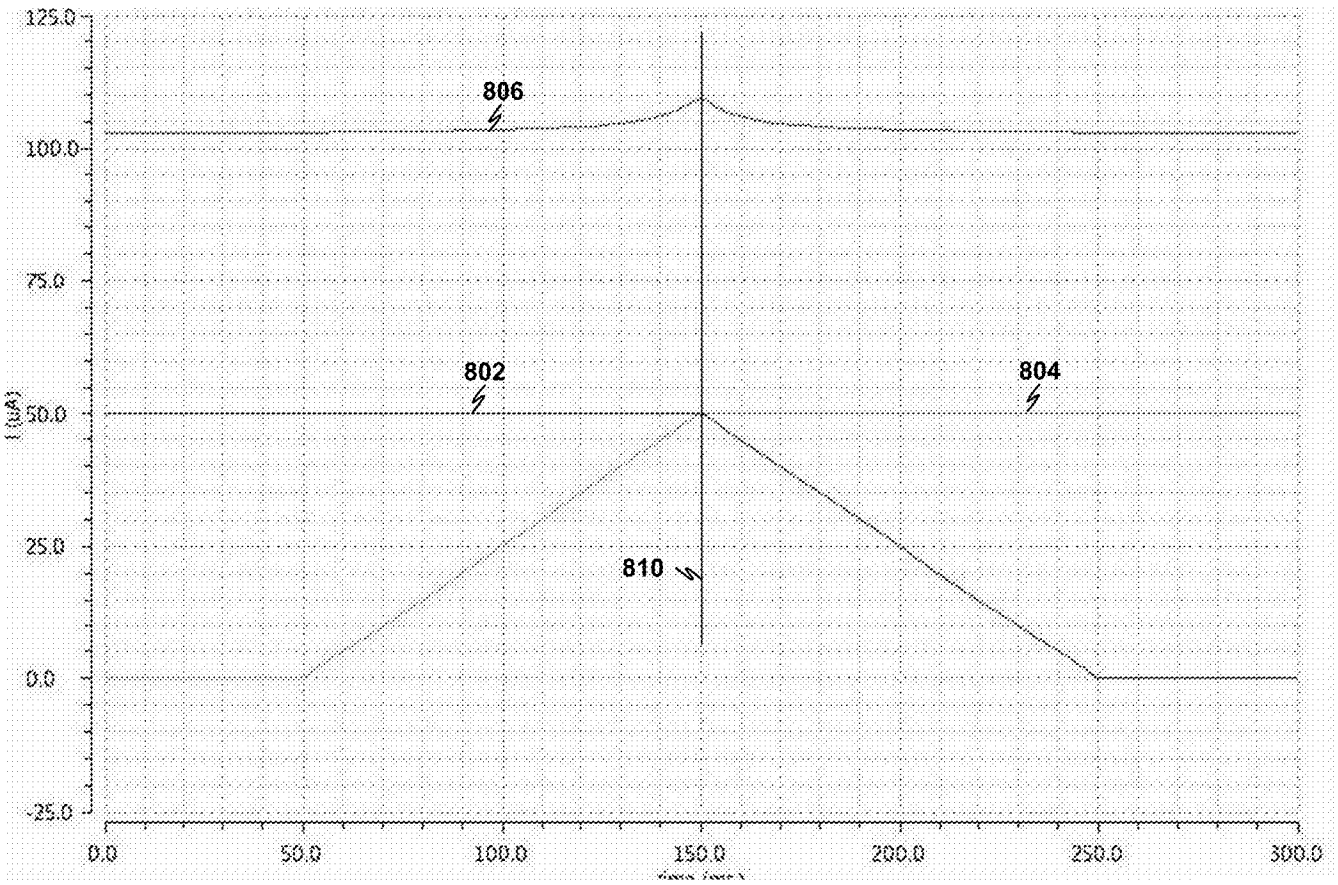
FIG. 8 is a second graphical illustration of a performance of the decision module of FIG. 6, in accordance with one or more techniques of this disclosure.

FIG. 8 is a second graphical illustration of a performance of the decision module of FIG. 6, in accordance with one or more techniques of this disclosure. As shown, composite sensed current 806 changes from being proportional to first sensed current 802 to being proportional to second sensed current 804 at time 810. Composite sensed current 806, however, remains continuous during the change at time 810, which may simplify a control of an LDO using composite sensed current 806 compared to control using a sensed current having a discontinuous transfer function.

Figure 9:
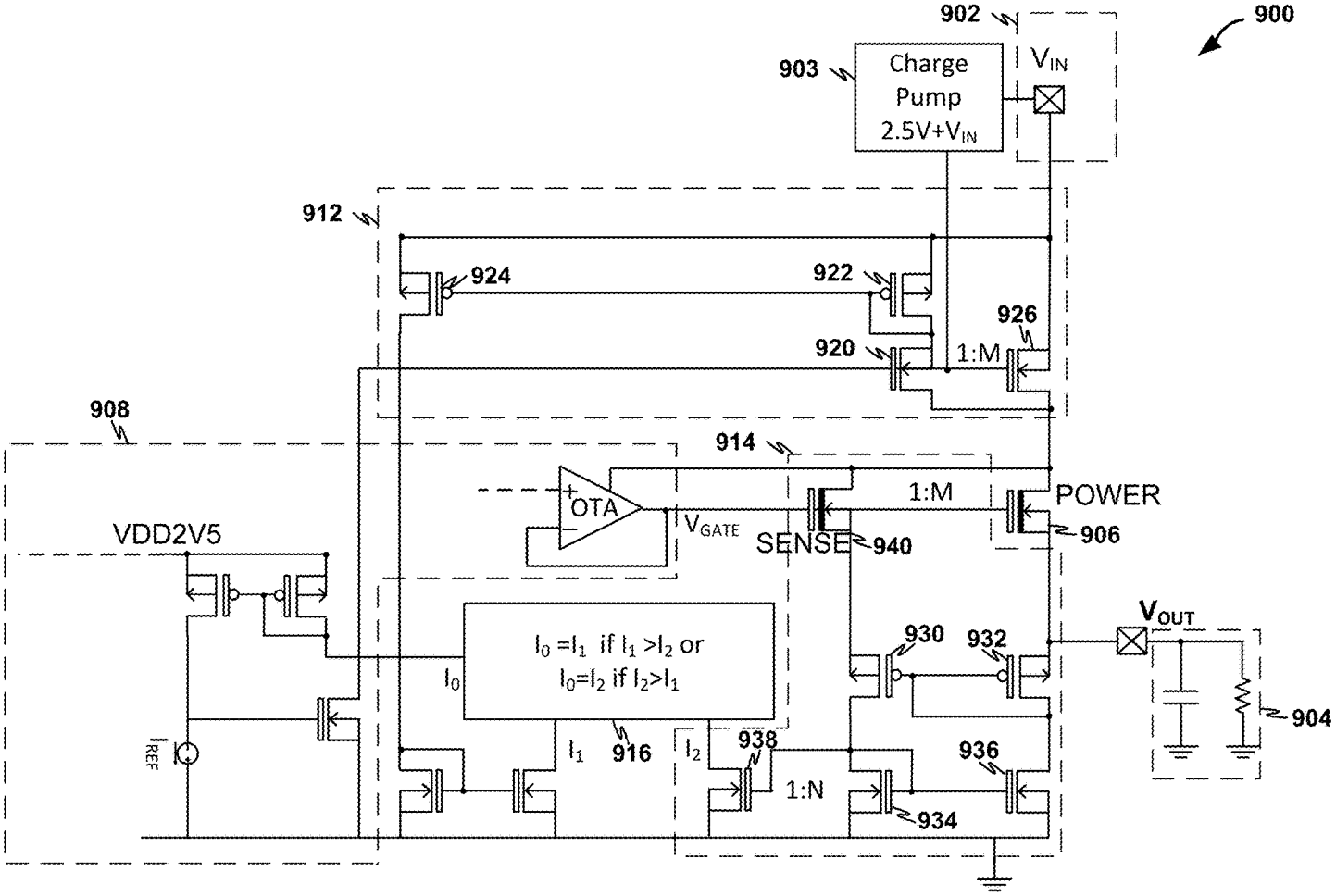
FIG. 9 is a circuit diagram illustrating an example second circuit of the system of FIG. 1, in accordance with one or more techniques of this disclosure.

FIG. 9 is a circuit diagram illustrating an example second circuit 900 of system 100 of FIG. 1, in accordance with one or more techniques of this disclosure. As illustrated, circuit 900 includes voltage source 902, charge pump 903, load 904, pass module 906, control module 908, first sensing module 912, second sensing module 914, and decision module 916. Voltage source 902 may be an example of voltage source 102 of FIG. 1. Charge pump 903 may be a charge pump configured to increase a voltage generated by voltage source 902 by 2.5 volts (V). Load 904 may be an example of load 104 of FIG. 1. Pass module 906 may be an example of pass module 106 of FIG. 1. Control module 908 may be an example of a component of control module 108 of FIG. 1. First sensing module 912 may be an example of first sensing module 112 of FIG. 1. Second sensing module 914 may be an example of second sensing module 114 of FIG. 1. For example, second sensing module 912 may include transistors 930, 932, 934, 936, 938, and 940, which may be substantially similar to transistors 320-340 of FIG. 3. Decision module 916 may be an example of decision module 116 of FIG. 1. In some examples, decision module 916 may be substantially similar to decision module 616 of FIG. 6.

First sensing module 912 may include transistors 920, 922, and 924, which may be substantially similar to transistors 220, 222, and 224 of FIG. 2. For instance, transistor 920 may form a '1' to 'N' current mirror with pass module 906, transistor 924 may form current mirror with transistor 922. Additionally, first sensing module 912 may further include switching element 926 to permit first sensing module 912 to generate first sensed current using a current at switching element 926 rather than using a current at pass module 906. In this way, pass device 906 may be an N-channel depletion device that requires no current from charge pump 903, thereby permitting all dynamic current to be supplied from VIN of voltage source 902. The example illustrated in FIG. 9 is particularly suitable for high current applications with the requirements of very low quiescent current. In some examples, switching element 926 may be used as a current limiting agent during current limitation for a current path that includes voltage source 902, pass device 906, and load 904.

Figure 10:
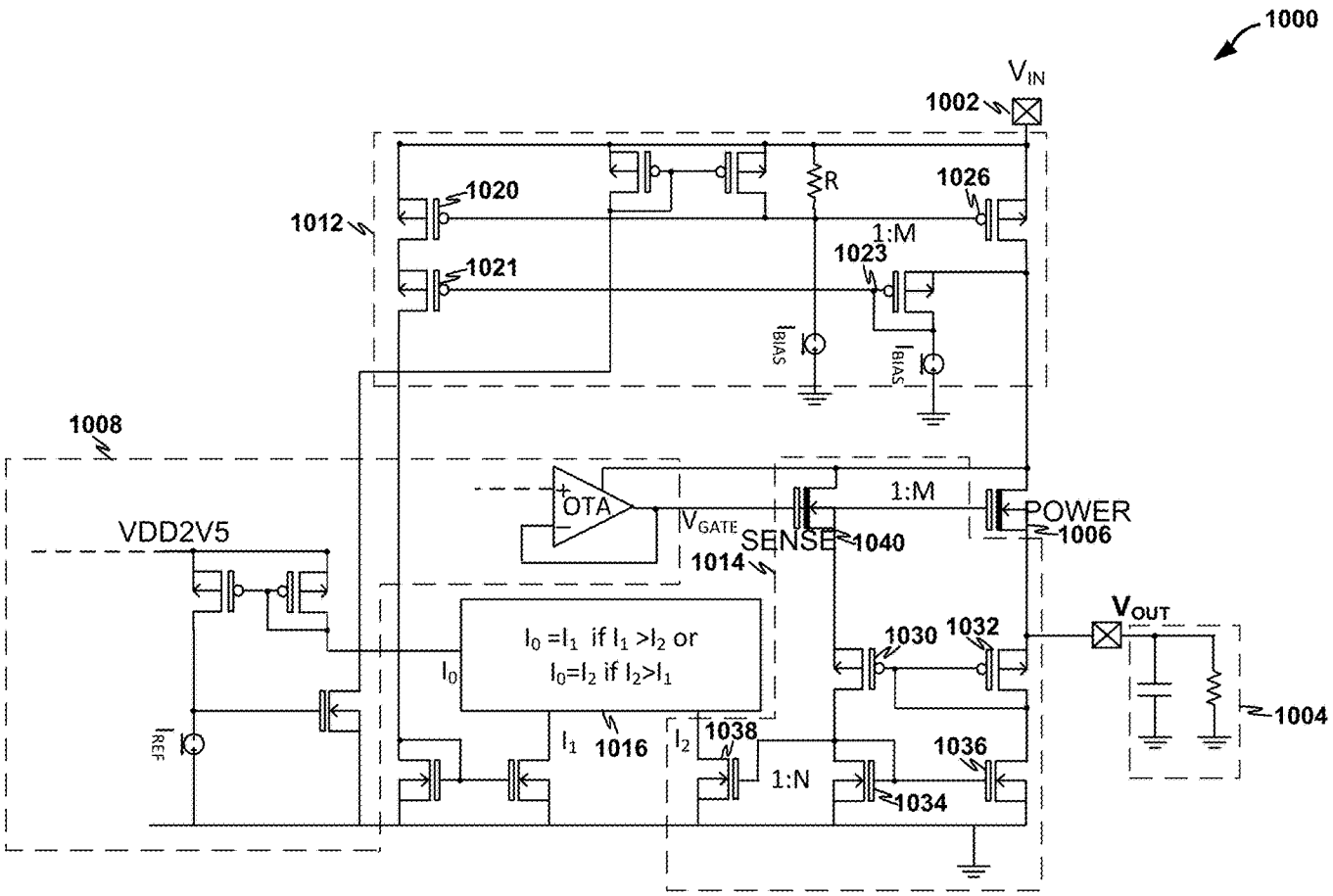
FIG. 10 is a circuit diagram illustrating an example third circuit of the system of FIG. 1, in accordance with one or more techniques of this disclosure.

FIG. 10 is a circuit diagram illustrating an example third circuit 1000 of the system of FIG. 1, in accordance with one or more techniques of this disclosure. As illustrated, circuit 1000 includes voltage source 1002, load 1004, pass module 1006, control module 1008, first sensing module 1012, second sensing module 1014, and decision module 1016. Voltage source 1002 may be an example of voltage source 102 of FIG. 1. Load 1004 may be an example of load 104 of FIG. 1. Pass module 1006 may be an example of pass module 106 of FIG. 1. Control module 1008 may be an example of a component of control module 108 of FIG. 1. First sensing module 1012 may be an example of first sensing module 112 of FIG. 1. Second sensing module 1014 may be an example of second sensing module 114 of FIG. 1. For example, second sensing module 1014 may include transistors 1030, 1032, 1034, 1036, 1038, and 1040, which may be substantially similar to transistors 330-340 of FIG. 3. Decision module 1016 may be an example of decision module 116 of FIG. 1. In some examples, decision module 1016 may be substantially similar to decision module 616 of FIG. 6.

First sensing module 1012 may include transistors 1020, 1021, and 1023, and switching element 1026. In this example, switching element 1026 is configured to receive an input voltage from voltage source 1002. Transistor 1020 may form a '1' to 'M' current mirror with switching element 1026, which may generate a first sensed current that is proportional to a current at switching element 1026 when switching element 1026 is operating in a first mode. In some examples, the first mode may be saturation mode. As used herein, a switching element may operate in a saturation mode when a resistance of the switching element depends on a gate voltage at the switching element such that the switching element may operate as a variable resistor. Transistor 1021 may reduce (e.g., choke) the first sensed current when switching element 1026 is operating in a second mode. In some examples the second mode may be $RDS_{ON}$ mode. As used herein, a switching element may operate in $RDS_{ON}$ mode when a resistance of the switching element only slightly depends on a gate voltage at the switching element such that the switching element may operate as a switch. For example, when switching element 1026 is in $RDS_{ON}$ mode (e.g., switched ON) then switching element 1021 acts as a choke (e.g., saturation mode) to reduce the current through a branch including switching elements 1020-1021. If there were no choke, when switching element 1026 is operating in $RDS_{ON}$ mode, switching element 1020 would operate in an $RDS_{ON}$ mode. As such, switching element 1020 would have no current limitation. That is why switching element 1021 is used to sense the drain to source voltage of switching element 1026 and to induce the same drain to source voltage on switching element 1020 when switching element 1020 has the same current as $I_{BIAS}$. But if the current were to be bigger, the drain to source voltage on switching element 1020 may be reduced even further, thereby inducing a lower current when switching element 1026 is in $RDS_{ON}$ mode. However, when the current limitation loop, controlled and initiated by second sensing module 1014, begins to reduce the gate to source voltage on switching element 1026 causing switching element 1026 to enter saturation mode, the drain to source voltage on switching element 1026 increases. As such, switching element 1021 causes the drain to source voltage of switching element 1020 to increase to permit switching element 1020 to enter saturation mode. In this way, the currents between switching elements 1020 and 1026 become ratio-metric or proportional.

Figure 11:
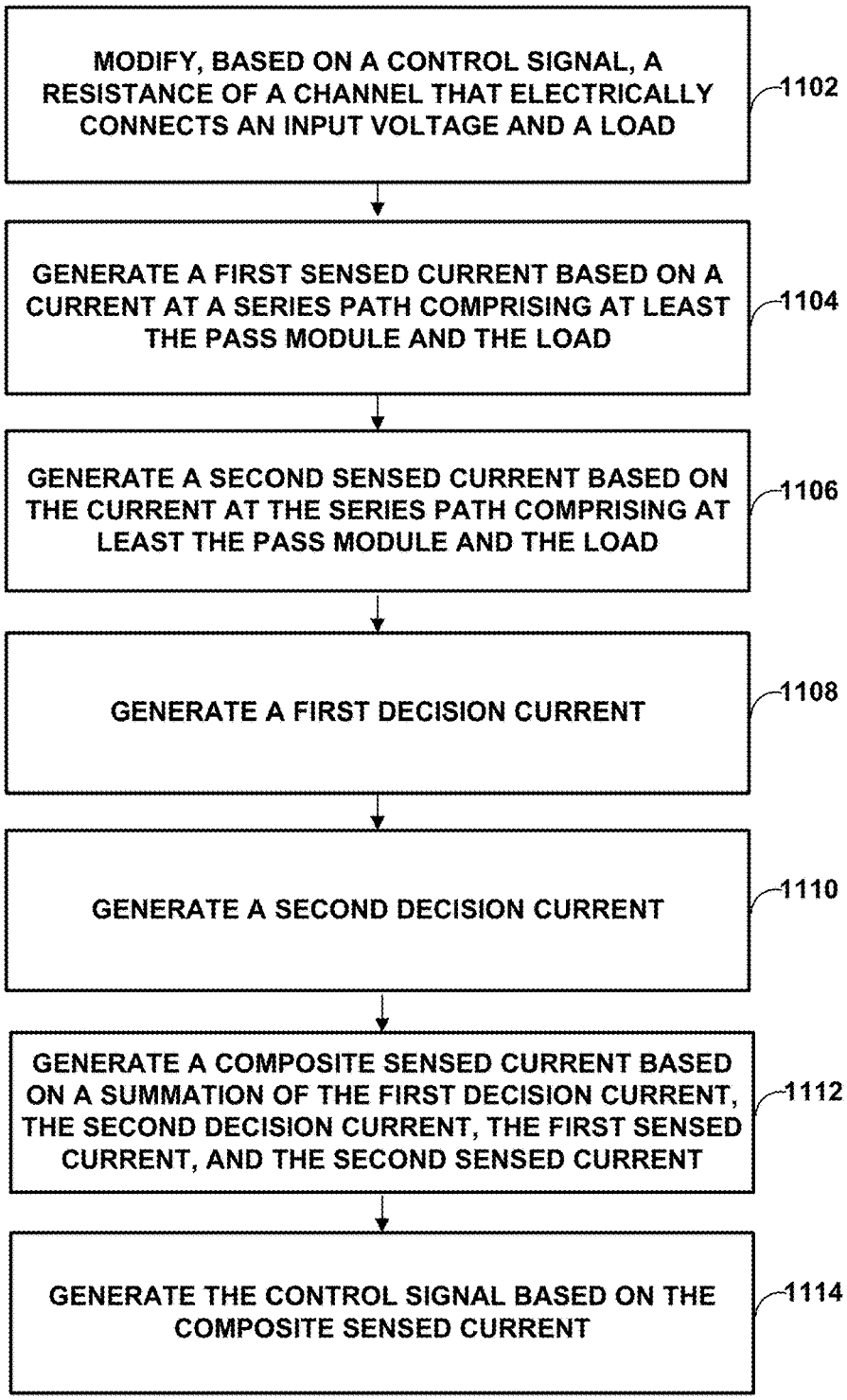
FIG. 11 is a flow diagram consistent with techniques that may be performed by a circuit in accordance with this disclosure.

FIG. 11 is a flow diagram consistent with techniques that may be performed by a circuit in accordance with this disclosure. For purposes of illustration only, the example operations are described below within the context of system 100 of FIG. 1, circuit 200 of FIG. 2, circuit 300 of FIG. 3, circuit 500 of FIG. 5, circuit 600 of FIG. 6, circuit 900 of FIG. 9, and circuit 1000 of FIG. 10. However, the techniques described below can be used in any permutation, and in any combination, with voltage source 102, load 104, pass module 106, control module 108, first sensing module 112, second sensing module 114, and decision module 116.

In accordance with one or more techniques of this disclosure, pass module 106 modifies, based on a control signal, a resistance of a channel that electrically connects an input voltage and a load (1102). First sensing module 112 generates a first sensed current based on a current at a series path comprising at least the pass module and the load (1104). Second sensing module 114 generates a second sensed current based on the current at the series path comprising at least the pass module and the load (1106). Decision module 116 generates a first decision current (1108). For example, transistors 658 and 660 of FIG. 6 form a first decision current mirror configured to generate the first decision current. Decision module 116 generates a second decision current (1110). For example, transistors 678 and 680 of FIG. 6 form a first decision current mirror configured to generate the first decision current. Decision module 116 generates a composite sensed current based on a summation of the first decision current, the second decision current, the first sensed current, and the second sensed current (1112). For example, transistors 690 and 692 of FIG. 6 form a current mirror configured to generate the composite sensed current based on a summation of the first decision current generated by transistor 660, the second decision current generated by transistor 680, a current generated by transistor 652 that corresponds to the first sensed current, and a current generated by transistor 672 that corresponds to the second sensed current. Decision module 116 generates the control signal based on the composite sensed current (1114).

The following examples may illustrate one or more aspects of the disclosure.

Example 1

A circuit for voltage regulation comprising: a pass module configured to modify, based on a control signal, a resistance of a channel that electrically connects an input voltage and a load; a first sensing module configured to generate a first sensed current based on a current at a series path comprising at least the pass module and the load; a second sensing module configured to generate a second sensed current based on the current at the series path comprising at least the pass module and the load; a decision module configured to: generate a first decision current that corresponds to a subtraction of the first sensed current from the second sensed current when the second sensed current is greater than the first sensed current and corresponds to zero current when the second sensed current is not greater than the first sensed current; generate a second decision current that corresponds to a subtraction of the second sensed current from the first sensed current when the first sensed current is greater than the second sensed current and corresponds to zero current when the first sensed current is not greater than the second sensed current; and generate a composite sensed current based on a summation of the first decision current, the second decision current, the first sensed current, and the second sensed current; and a control module configured to generate the control signal based on the composite sensed current.

Example 2

The circuit of example 1, wherein, to generate the composite sensed current, the decision module is configured to: generate the composite sensed current to be proportional to the first sensed current when the first sensed current is greater than the second sensed current; and generate the composite sensed current to be proportional to the second sensed current when the second sensed current is greater than the first sensed current.

Example 3

The circuit of any combination of examples 1-2, wherein: to generate the first sensed current, the first sensing module is configured to generate the first sensed current to be proportional to the current at the series path comprising at least the pass module and the load when a voltage output at the pass module is less than a first threshold; to generate the second sensed current, the second sensing module is configured to generate the second sensed current to be proportional to the current at the series path comprising at least the pass module and the load when the voltage output at the pass module is greater than a second threshold; and the second threshold is less than the first threshold.

Example 4

The circuit of any combination of examples 1-3, wherein the decision module comprises: a first sensed current mirror configured to generate a first source current that corresponds to the first sensed current; a second sensed current mirror configured to generate a first sink current that corresponds to the second sensed current; a first diode configured to supply a first diode current corresponding to a subtraction of the first source current from the first sink current when the first sink current is greater than the first source current and to correspond to zero current when the first sink current is not greater than the first source current; a first decision current mirror configured to generate the first decision current to correspond to the first diode current; a third sensed current mirror configured to generate a second source current that corresponds to the second sensed current; a fourth sensed current mirror configured to generate a second sink current that corresponds to the first sensed current; a second diode configured to supply a second diode current corresponding to a subtraction of the second source current from the second sink current when the second sink current is greater than the second source current and to correspond to zero current when the second sink current is not greater than the second source current; and a second decision current mirror configured to generate the second decision current to correspond to the second diode current.

Example 5

The circuit of any combination of examples 1-4, wherein the decision module further comprises: a fifth sensed current mirror configured to generate a current corresponding to the first sensed current; a sixth sensed current mirror configured to generate a current corresponding to the second sensed current; and a composite sensed current mirror configured to generate the composite sensed current to correspond to a summation of the first decision current from the first decision current mirror, the second decision current from the second decision current mirror, the current corresponding to the first sensed current from the fifth sensed current mirror, and the current corresponding to the second sensed current from the sixth sensed current mirror.

Example 6

The circuit of any combination of examples 1-5, wherein: the series path further comprises a N-type metal-oxide-semiconductor field-effect transistor (MOSFET); a gate of the N-type MOSFET is configured to receive a voltage that is greater than the input voltage; and to generate the first sensed current, the first sensing module is configured to generate the first sensed current to be proportional to a current at the N-type MOSFET.

Example 7

The circuit of any combination of examples 1-6, wherein: the series path further comprises a P-type metal-oxide-semiconductor field-effect transistor (MOSFET); a gate of the P-type MOSFET is configured to receive a voltage that is less than the input voltage; and to generate the first sensed current, the first sensing module is configured to generate the first sensed current to be proportional to a current at the P-type MOSFET.

Example 8

The circuit of any combination of examples 1-7, wherein: the series path further comprises a first switching element that is configured to receive the input voltage; to generate the first sensed current, the first sensing module is configured to generate the first sensed current to be proportional to a current at the first switching element when the first switching element is operating in a first mode; and the first sensing module comprises a second switching element configured to reduce the first sensed current when the first switching element is operating in a second mode.

Example 9

The circuit of any combination of examples 1-8, wherein the first switching element is a metal-oxide-semiconductor field-effect transistor (MOSFET), wherein the first mode is saturation mode, and wherein the second mode is $RDS_{ON}$ mode.

Example 10

A method for voltage regulation comprising: modifying, by a pass module of a circuit, based on a control signal, a resistance of a channel that electrically connects an input voltage and a load; generating, by a first sensing module of the circuit, a first sensed current based on a current at a series path comprising at least the pass module and the load; generating, by a second sensing module of the circuit, a second sensed current based on the current at the series path comprising at least the pass module and the load; generating, by a decision module of the circuit, a first decision current that corresponds to a subtraction of the first sensed current from the second sensed current when the second sensed current is greater than the first sensed current and corresponds to zero current when the second sensed current is not greater than the first sensed current; generating, by the decision module, a second decision current that corresponds to a subtraction of the second sensed current from the first sensed current when the first sensed current is greater than the second sensed current and corresponds to zero current when the first sensed current is not greater than the second sensed current; generating, by the decision module, a composite sensed current based on a summation of the first decision current, the second decision current, the first sensed current, and the second sensed current; and generating, by a control module of the circuit, the control signal based on the composite sensed current.

Example 11

The method of example 10, wherein generating the composite sensed current comprises: generating the composite sensed current to be proportional to the first sensed current when the first sensed current is greater than the second sensed current; and generating the composite sensed current to be proportional to the second sensed current when the second sensed current is greater than the first sensed current.

Example 12

The method of any combination of examples 10-11, wherein: generating the first sensed current comprises generating, by the first sensing module, the first sensed current to be proportional to the current at the series path comprising at least the pass module and the load when a voltage output at the pass module is less than a first threshold; generating the second sensed current comprises generating, by the second sensing module, the second sensed current to be proportional to the current at the series path comprising at least the pass module and the load when the voltage output at the pass module is greater than a second threshold; and the second threshold is less than the first threshold.

Example 13

The method of any combination of examples 10-12, further comprising: generating, by a first sensed current mirror, a first source current that corresponds to the first sensed current; generating, by a second sensed current mirror, a first sink current that corresponds to the second sensed current; supplying, by a first diode, a first diode current corresponding to a subtraction of the first source current from the first sink current when the first sink current is greater than the first source current and to correspond to zero current when the first sink current is not greater than the first source current; generating, by a first decision current mirror, the first decision current to correspond to the first diode current; generating, by a third sensed current mirror, a second source current that corresponds to the second sensed current; generating, by a fourth sensed current mirror, a second sink current that corresponds to the first sensed current; supplying, by a second diode, a second diode current corresponding to a subtraction of the second source current from the second sink current when the second sink current is greater than the second source current and to correspond to zero current when the second sink current is not greater than the second source current; and generating, by a second decision current mirror, the second decision current to correspond to the second diode current.

Example 14

The method of any combination of examples 10-13, further comprising: generating, by a fifth sensed current mirror, a current corresponding to the first sensed current; generating, by a sixth sensed current mirror, a current corresponding to the second sensed current; and generating, by a composite sensed current mirror, the composite sensed current to correspond to a summation of the first decision current from the first decision current mirror, the second decision current from the second decision current mirror, the current corresponding to the first sensed current from the fifth sensed current mirror, and the current corresponding to the second sensed current from the sixth sensed current mirror.

Example 15

The method of any combination of examples 10-14, wherein the series path further comprises a N-type metal-oxide-semiconductor field-effect transistor (MOSFET), the method further comprising: receiving, at a gate of the N-type MOSFET, a voltage that is greater than the input voltage, wherein generating the first sensed current comprises generating, by the first sensing module, the first sensed current to be proportional to a current at the N-type MOSFET.

Example 16

The method of any combination of examples 10-15, wherein the series path further comprises a P-type metal-oxide-semiconductor field-effect transistor (MOSFET), the method further comprising: receiving, at a gate of the P-type MOSFET, a voltage that is less than the input voltage, wherein generating the first sensed current comprises generating, by the first sensing module, the first sensed current to be proportional to a current at the P-type MOSFET.

Example 17

The method of any combination of examples 10-16, wherein the series path further comprises a first switching element that is configured to receive the input voltage and the first sensing module comprises a second switching element, wherein: generating the first sensed current comprises generating the first sensed current to be proportional to a current at the first switching element when the first switching element is operating in a first mode; and the method further comprises: reducing, by the second switching element, the first sensed current when the first switching element is operating in a second mode.

Example 18

The method of any combination of examples 10-17, wherein the first switching element is a metal-oxide-semiconductor field-effect transistor (MOSFET), wherein the first mode is saturation mode, and wherein the second mode is $RDS_{ON}$ mode.

Example 19

A circuit comprising: a voltage source configured to supply an input voltage; a load; a pass module configured to modify, based on a control signal, a resistance of a channel that electrically connects the input voltage and the load; a first sensing module configured to generate a first sensed current to be proportional to a current at a series path comprising at least the pass module and the load when a voltage output at the pass module is less than a first threshold; a second sensing module configured to generate a second sensed current to be proportional to the current at the series path comprising at least the pass module and the load when the voltage output at the pass module is greater than a second threshold, the second threshold being less than the first threshold; a decision module configured to: generate a first decision current that corresponds to a subtraction of the first sensed current from the second sensed current when the second sensed current is greater than the first sensed current and corresponds to zero current when the second sensed current is not greater than the first sensed current; generate a second decision current that corresponds to a subtraction of the second sensed current from the first sensed current when the first sensed current is greater than the second sensed current and corresponds to zero current when the first sensed current is not greater than the second sensed current; and generate a composite sensed current based on a summation of the first decision current, the second decision current, the first sensed current, and the second sensed current; and; and a control module configured to generate the control signal based on the composite sensed current.

Example 20

The circuit of example 19, wherein, to generate the composite sensed current, the decision module is configured to: generate the composite sensed current to be proportional to the first sensed current when the first sensed current is greater than the second sensed current; and generate the composite sensed current to be proportional to the second sensed current when the second sensed current is greater than the first sensed current.

Various aspects have been described in this disclosure. These and other aspects are within the scope of the following claims.

The invention claimed is:

1. A circuit for voltage regulation comprising:

a pass module configured to modify, based on a control signal, a resistance of a channel that electrically connects an input voltage and a load;

a first sensing module configured to generate a first sensed current based on a current at a series path comprising at least the pass module and the load;

a second sensing module configured to generate a second sensed current based on the current at the series path comprising at least the pass module and the load;

a decision module configured to:

generate a first decision current that corresponds to a subtraction of the first sensed current from the second sensed current when the second sensed current is greater than the first sensed current and corresponds to zero current when the second sensed current is not greater than the first sensed current;

generate a second decision current that corresponds to a subtraction of the second sensed current from the first sensed current when the first sensed current is greater than the second sensed current and corresponds to zero current when the first sensed current is not greater than the second sensed current; and generate a composite sensed current based on a summation of the first decision current, the second decision current, the first sensed current, and the second sensed current; and a control module configured to generate the control signal based on the composite sensed current.

2. The circuit of claim 1, wherein, to generate the composite sensed current, the decision module is configured to:

generate the composite sensed current to be proportional to the first sensed current when the first sensed current is greater than the second sensed current; and generate the composite sensed current to be proportional to the second sensed current when the second sensed current is greater than the first sensed current.

3. The circuit of claim 1, wherein:

to generate the first sensed current, the first sensing module is configured to generate the first sensed current to be proportional to the current at the series path comprising at least the pass module and the load when a voltage output at the pass module is less than a first threshold;

to generate the second sensed current, the second sensing module is configured to generate the second sensed current to be proportional to the current at the series path comprising at least the pass module and the load when the voltage output at the pass module is greater than a second threshold; and the second threshold is less than the first threshold.

4. The circuit of claim 1, wherein the decision module comprises:

a first sensed current mirror configured to generate a first source current that corresponds to the first sensed current;

a second sensed current mirror configured to generate a first sink current that corresponds to the second sensed current;

a first diode configured to supply a first diode current corresponding to a subtraction of the first source current from the first sink current when the first sink current is greater than the first source current and to correspond to zero current when the first sink current is not greater than the first source current;

a first decision current mirror configured to generate the first decision current to correspond to the first diode current;

a third sensed current mirror configured to generate a second source current that corresponds to the second sensed current;

a fourth sensed current mirror configured to generate a second sink current that corresponds to the first sensed current;

a second diode configured to supply a second diode current corresponding to a subtraction of the second source current from the second sink current when the second sink current is greater than the second source current and to correspond to zero current when the second sink current is not greater than the second source current; and a second decision current mirror configured to generate the second decision current to correspond to the second diode current.

5. The circuit of claim 4, wherein the decision module further comprises:

a fifth sensed current mirror configured to generate a current corresponding to the first sensed current;

a sixth sensed current mirror configured to generate a current corresponding to the second sensed current; and a composite sensed current mirror configured to generate the composite sensed current to correspond to a summation of the first decision current from the first decision current mirror, the second decision current from the second decision current mirror, the current corresponding to the first sensed current from the fifth sensed current mirror, and the current corresponding to the second sensed current from the sixth sensed current mirror.

6. The circuit of claim 1, wherein:

the series path further comprises a N-type metal-oxide-semiconductor field-effect transistor (MOSFET);

a gate of the N-type MOSFET is configured to receive a voltage that is greater than the input voltage; and to generate the first sensed current, the first sensing module is configured to generate the first sensed current to be proportional to a current at the N-type MOSFET.

7. The circuit of claim 1, wherein:

the series path further comprises a P-type metal-oxide-semiconductor field-effect transistor (MOSFET);

a gate of the P-type MOSFET is configured to receive a voltage that is less than the input voltage; and to generate the first sensed current, the first sensing module is configured to generate the first sensed current to be proportional to a current at the P-type MOSFET.

8. The circuit of claim 1, wherein:

the series path further comprises a first switching element that is configured to receive the input voltage;

to generate the first sensed current, the first sensing module is configured to generate the first sensed current to be proportional to a current at the first switching element when the first switching element is operating in a first mode; and the first sensing module comprises a second switching element configured to reduce the first sensed current when the first switching element is operating in a second mode.

9. The circuit of claim 8, wherein the first switching element is a metal-oxide-semiconductor field-effect transistor (MOSFET), wherein the first mode is saturation mode, and wherein the second mode is $RDS_{ON}$ mode.

10. A method for voltage regulation comprising:

modifying, by a pass module of a circuit, based on a control signal, a resistance of a channel that electrically connects an input voltage and a load;

generating, by a first sensing module of the circuit, a first sensed current based on a current at a series path comprising at least the pass module and the load;

generating, by a second sensing module of the circuit, a second sensed current based on the current at the series path comprising at least the pass module and the load;

generating, by a decision module of the circuit, a first decision current that corresponds to a subtraction of the first sensed current from the second sensed current when the second sensed current is greater than the first sensed current and corresponds to zero current when the second sensed current is not greater than the first sensed current;

generating, by the decision module, a second decision current that corresponds to a subtraction of the second sensed current from the first sensed current when the first sensed current is greater than the second sensed current and corresponds to zero current when the first sensed current is not greater than the second sensed current;

generating, by the decision module, a composite sensed current based on a summation of the first decision current, the second decision current, the first sensed current, and the second sensed current; and generating, by a control module of the circuit, the control signal based on the composite sensed current.

11. The method of claim 10, wherein generating the composite sensed current comprises:

generating the composite sensed current to be proportional to the first sensed current when the first sensed current is greater than the second sensed current; and generating the composite sensed current to be proportional to the second sensed current when the second sensed current is greater than the first sensed current.

12. The method of claim 10, wherein:

generating the first sensed current comprises generating, by the first sensing module, the first sensed current to be proportional to the current at the series path comprising at least the pass module and the load when a voltage output at the pass module is less than a first threshold;

generating the second sensed current comprises generating, by the second sensing module, the second sensed current to be proportional to the current at the series path comprising at least the pass module and the load when the voltage output at the pass module is greater than a second threshold; and the second threshold is less than the first threshold.

13. The method of claim 10, further comprising:

generating, by a first sensed current mirror, a first source current that corresponds to the first sensed current;

generating, by a second sensed current mirror, a first sink current that corresponds to the second sensed current;

supplying, by a first diode, a first diode current corresponding to a subtraction of the first source current from the first sink current when the first sink current is greater than the first source current and to correspond to zero current when the first sink current is not greater than the first source current;

generating, by a first decision current mirror, the first decision current to correspond to the first diode current;

generating, by a third sensed current mirror, a second source current that corresponds to the second sensed current;

generating, by a fourth sensed current mirror, a second sink current that corresponds to the first sensed current;

supplying, by a second diode, a second diode current corresponding to a subtraction of the second source current from the second sink current when the second sink current is greater than the second source current and to correspond to zero current when the second sink current is not greater than the second source current; and generating, by a second decision current mirror, the second decision current to correspond to the second diode current.

14. The method of claim 13, further comprising:

generating, by a fifth sensed current mirror, a current corresponding to the first sensed current;

generating, by a sixth sensed current mirror, a current corresponding to the second sensed current; and generating, by a composite sensed current mirror, the composite sensed current to correspond to a summation of the first decision current from the first decision current mirror, the second decision current from the second decision current mirror, the current corresponding to the first sensed current from the fifth sensed current mirror, and the current corresponding to the second sensed current from the sixth sensed current mirror.

15. The method of claim 10, wherein the series path further comprises a N-type metal-oxide-semiconductor field-effect transistor (MOSFET), the method further comprising:

receiving, at a gate of the N-type MOSFET, a voltage that is greater than the input voltage, wherein generating the first sensed current comprises generating, by the first sensing module, the first sensed current to be proportional to a current at the N-type MOSFET.

16. The method of claim 10, wherein the series path further comprises a P-type metal-oxide-semiconductor field-effect transistor (MOSFET), the method further comprising:

receiving, at a gate of the P-type MOSFET, a voltage that is less than the input voltage, wherein generating the first sensed current comprises generating, by the first sensing module, the first sensed current to be proportional to a current at the P-type MOSFET.

17. The method of claim 10, wherein the series path further comprises a first switching element that is configured to receive the input voltage and the first sensing module comprises a second switching element, wherein:

generating the first sensed current comprises generating the first sensed current to be proportional to a current at the first switching element when the first switching element is operating in a first mode; and the method further comprises:

reducing, by the second switching element, the first sensed current when the first switching element is operating in a second mode.

18. The method of claim 17, wherein the first switching element is a metal-oxide-semiconductor field-effect transistor (MOSFET), wherein the first mode is saturation mode, and wherein the second mode is $RDS_{ON}$ mode.

19. A circuit comprising:

a voltage source configured to supply an input voltage;

a load;

a pass module configured to modify, based on a control signal, a resistance of a channel that electrically connects the input voltage and the load;

a first sensing module configured to generate a first sensed current to be proportional to a current at a series path comprising at least the pass module and the load when a voltage output at the pass module is less than a first threshold;

a second sensing module configured to generate a second sensed current to be proportional to the current at the series path comprising at least the pass module and the load when the voltage output at the pass module is greater than a second threshold, the second threshold being less than the first threshold;

a decision module configured to:

generate a first decision current that corresponds to a subtraction of the first sensed current from the second sensed current when the second sensed current is greater than the first sensed current and corresponds to zero current when the second sensed current is not greater than the first sensed current;

generate a second decision current that corresponds to a subtraction of the second sensed current from the first sensed current when the first sensed current is greater than the second sensed current and corresponds to zero current when the first sensed current is not greater than the second sensed current; and generate a composite sensed current based on a summation of the first decision current, the second decision current, the first sensed current, and the second sensed current; and; and a control module configured to generate the control signal based on the composite sensed current.

20. The circuit of claim 19, wherein, to generate the composite sensed current, the decision module is configured to:

generate the composite sensed current to be proportional to the first sensed current when the first sensed current is greater than the second sensed current; and generate the composite sensed current to be proportional to the second sensed current when the second sensed current is greater than the first sensed current.

* * * * *